US005544507A

United States Patent [19]

Lin

[11] Patent Number: 5,544,507

[45] **Date of Patent: *Aug. 13, 1996**

[54] DOOR LOCK ASSEMBLY

[75] Inventor: Jui-Chang Lin, Kaohsiung Hsien, Taiwan

[73] Assignee: Taiwan Fu Hsing Industrial Co., Ltd., Kaohsiung Hsien, Taiwan

[ * ] Notice: The term of this patent shall not extend beyond the expiration date of Pat. No. 5,325,687.

[21] Appl. No.: 196,755

[22] Filed: Feb. 15, 1994

[51] Int. Cl.[6] ..... E05B 59/00

[52] U.S. Cl. ..... 70/107; 70/224; 70/277

[58] Field of Search ..... 70/107, 224, 277–285

[56] References Cited

U.S. PATENT DOCUMENTS

| | | | |
|---|---|---|---|
| 3,990,277 | 11/1976 | Mullich | 70/107 |
| 3,999,789 | 12/1976 | Maurits et al. | 70/107 X |
| 4,011,741 | 3/1977 | Nolin | 70/107 |
| 4,183,563 | 1/1980 | Stevens | 70/107 X |
| 4,276,760 | 7/1981 | Nolin | 70/107 |
| 4,838,053 | 6/1989 | Shen | 70/224 X |
| 5,010,749 | 4/1991 | Lin | 70/190 |
| 5,010,752 | 4/1991 | Lin | 70/277 |
| 5,027,629 | 7/1991 | Liu | 70/107 X |
| 5,040,391 | 8/1991 | Lin | 70/277 |
| 5,150,592 | 9/1992 | Lin | 70/224 X |
| 5,186,030 | 2/1993 | Lin | 70/190 |
| 5,325,687 | 7/1994 | Lin | 70/107 |

*Primary Examiner*—Steven N. Meyers
*Assistant Examiner*—Suzanne L. Dino
*Attorney, Agent, or Firm*—Jacobson, Price, Holman & Stern, PLLC

[57] ABSTRACT

A door lock includes an inner cap and an outer cap, a slide is slidably disposed in the inner cap and includes a lower shoulder and an upper shoulder, an inner knob has a tube extended through the inner cap, a ring is fixed on the tube and has a projection for engaging with the lower shoulder so as to move the slide downward, another inner knob has an axle engaged with the inner cap, a disc is fixed on the axle and has a protrusion for engaging with the upper shoulder, the axle is rotated by the protrusion and the upper shoulder when the slide is moved downward by the ring.

2 Claims, 8 Drawing Sheets

DOOR LOCK ASSEMBLY

BACKGROUND OF THE INVENTION

1. Field of the Invention

The present invention relates to a lock, and more particularly to a door lock assembly.

2. Description of the Prior Art

Various kinds of door locks have been developed and widely used, in which one typical door lock is disclosed in U.S. Pat. No. 5,010,752 and 5,040,391 both to Lin, the locks are electronic door locks and can be used to actuate the lower latch only.

Another typical door lock is disclosed in U.S. Pat. Nos. 5,010,749, 5,150,592 and 5,186,030 all to Lin, the locks are auxiliary locks for actuating the upper latch only, the upper and lower latches are not coupled together, no mechanisms are disclosed for operating both types of the locks.

The present invention has arisen to provide a novel door lock assembly.

SUMMARY OF THE INVENTION

The primary objective of the present invention is to provide a door lock assembly including mechanisms for operating both the upper and the lower latches.

The invention is intended to provide a door lock assembly comprising an inner cap and an outer cap, a slide slidably disposed in the inner cap and including a lower shoulder and an upper shoulder, a first inner knob including a tube extended through the inner cap, a button slidably disposed in the first inner knob and slightly extended outward of the first inner knob, a rod slidably disposed in the tube and engaged with the button, a follower fixed on the rod and including two extensions, an outer knob engaged with the outer cap, a shaft secured to the tube, a pole extended through the shaft and including a first end secured to the outer knob and a second end having a disc fixed thereon, the disc including a groove for engaging with the extension of the follower, the disc and the outer knob being rotated in concert with the follower when the extension is engaged with the groove, the outer knob being freely rotatable when the extension is disengaged from the groove, a ring secured on the tube and including at least one first projection for engaging with the lower shoulder so as to move the slide downward, a second inner knob including an axle engaged with the inner cap, at least one disc secured on the axle and including at least one second projection for engaging with the upper shoulder, the axle being rotated by the second projection and the upper shoulder when the slide is moved downward by the ring and when the first inner knob is rotated, whereby, the axle is actuated by the first inner knob.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 10:
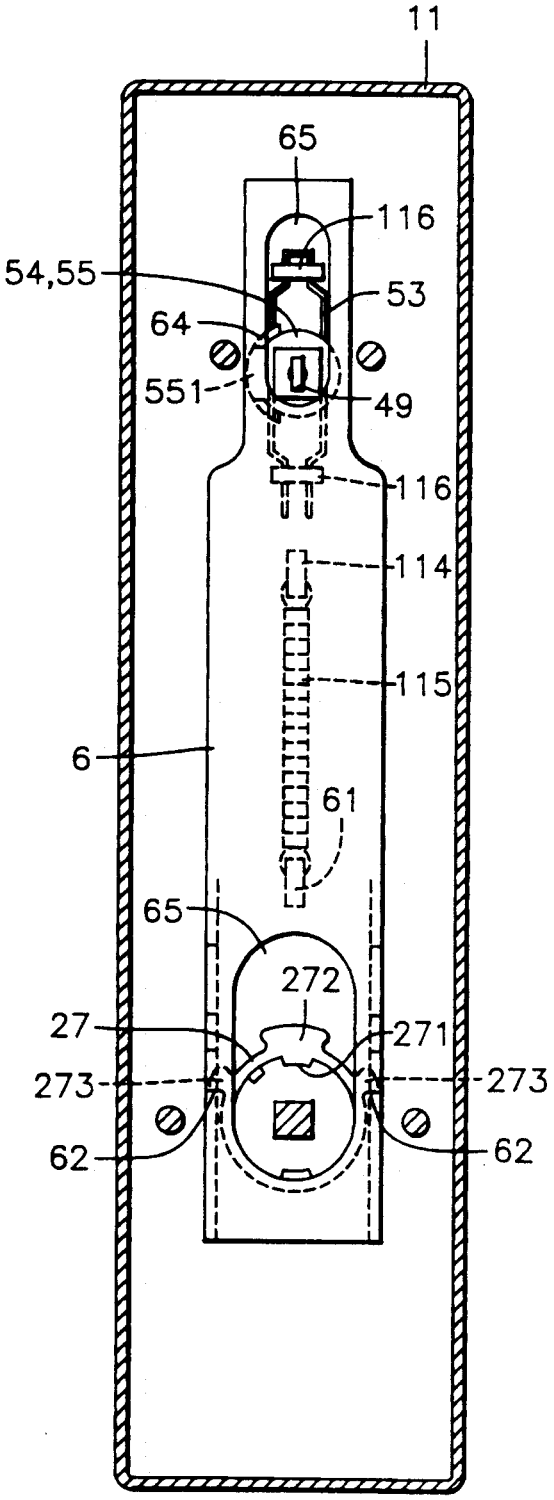
FIGS. 10 and 11 are cross sectional views taken along lines 10—10 of FIG. 3.
Figure 11:
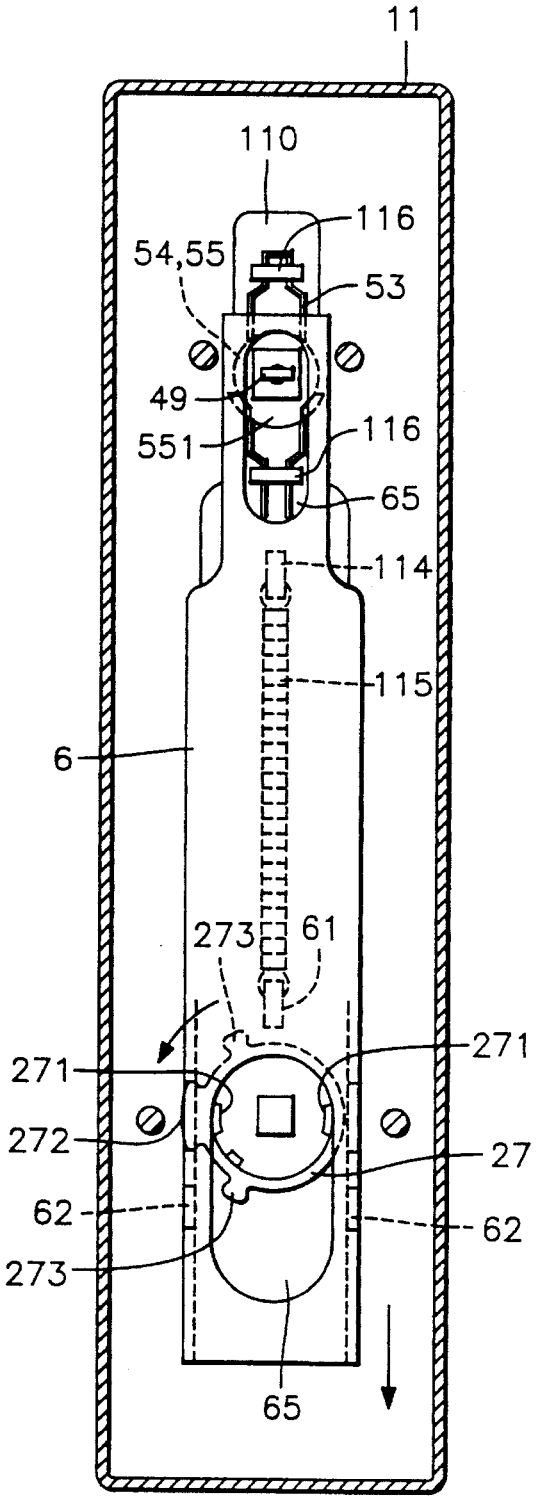

Referring to the drawings, and initially to FIGS. 1 to 5, a door lock assembly in accordance with the present invention is generally disposed in a door panel 10 and comprises an inner cap 11 and an outer cap 12 fixed together by screws 13, two latches 14, 15 extendible outward of the door panel 10 for engaging with recesses formed in the wall member (not shown) so as to lock the door in place, a plate 110 slidably engaged in the inner cap 11 and slidable up and down, the plate 110 includes a hole 111 provided in the lower portion for engaging with a tube 21 of an inner knob 2, the tube 21 including two pairs of slots 211, 212, a hole 112 provided in the upper portion for engaging with an axle 52 of another inner knob 5, the axle 52 including a square cross section and including an opening 51 formed therein, a pair of flanges 113 extended therefrom for engaging with and for guiding a slide 6 so as to guide the slide 6 moving up and down, a spring 115 including one end engaged with a hook 114 provided in the plate 110 and another end engaged with a hook 61 provided in the slide 6 for biasing the slide 6 upward, a pair of retaining rings 116 are provided in the plate 110 and located above and below the axle 52 respectively, a resilient member 53 is secured to the retaining rings 116 and grasps the axle 52 so as to position the axle 52 (FIGS. 10, 11), two discs 54, 55 engaged on the axle 52 and rotated in concert with the axle 52, the disc 54 includes two projections 541 and the disc 55 includes a projection 551 for engaging with two pairs of shoulders 64 formed in the slide 6 so as to move the slide 6 downward against the spring 115 (FIGS. 10, 11).

Figure 4:
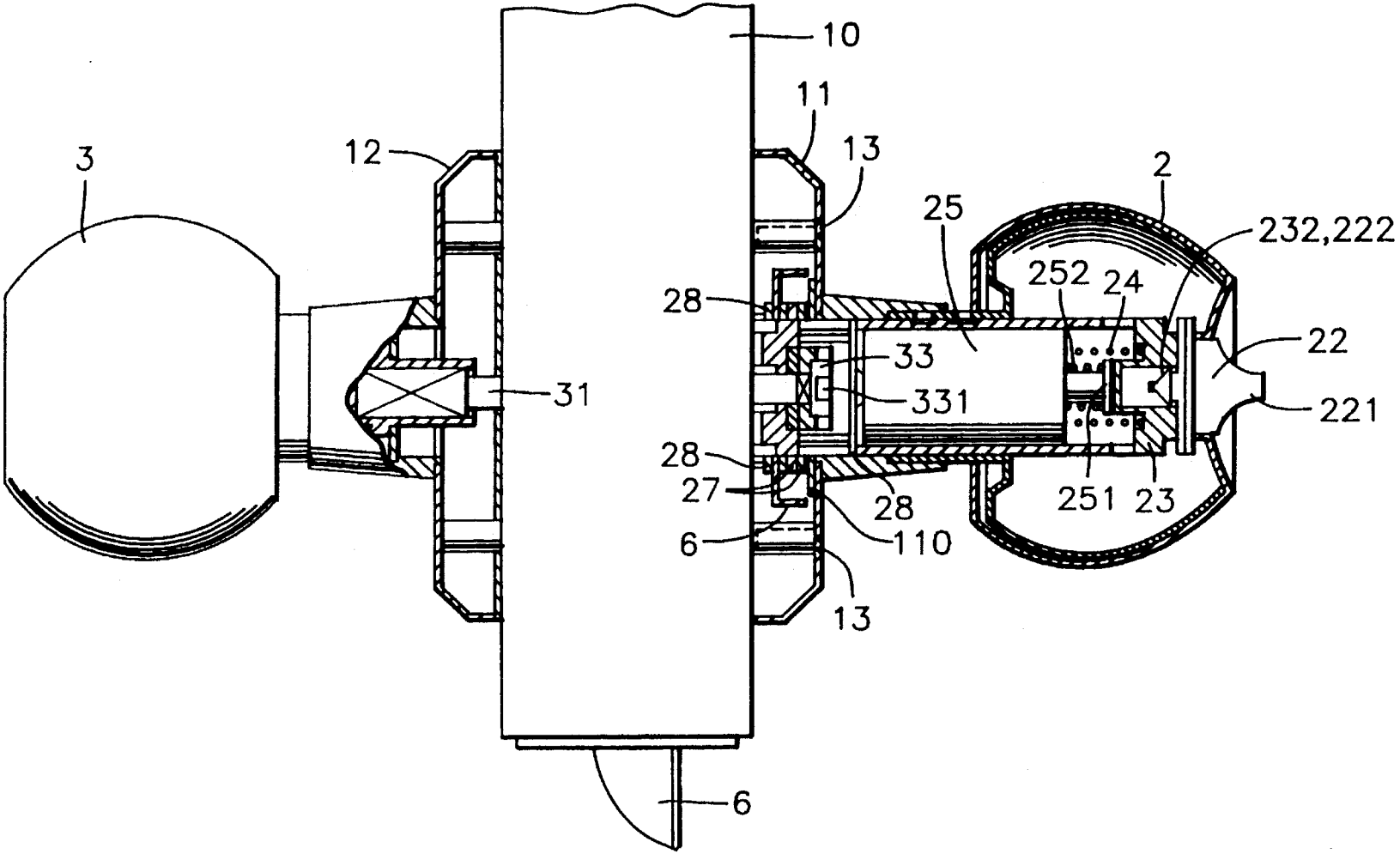
FIGS. 4 and 5 are cross sectional views taken along lines 4—4 of FIG. 3.

A button 22, a disc 23, a spring 24, a coil 25 and a follower 26 are received in the tube 21 of the inner knob 2, the button 22 includes a lug 221 extended outward of the inner knob 2 and can be rotated and depressed inward of the inner knob 2 against the spring 24, best shown in FIG. 4, and includes a rib 222 for engaging with either of two grooves 231, 232 which are formed in the disc 23 and are perpendicular with each other, the disc 23 includes a projection 233 for engaging with the coil 25, the spring 24 is engaged between the disc 23 and the coil 25 for biasing the disc 23 away from the coil 25, a rod 251 is slidably engaged in the coil 25 and includes one end for engaging with the projection 233 of the disc 23, a spring 252 is engaged on the rod 251 for biasing the rod 251 toward the disc 23, the follower 26 is fixed on the other end of the rod 251 and moves in concert with the rod 251 and includes two extensions 26i slidably engaged with the slots 211 such that the rod 251 is guided to move longitudinally in the tube 21 and can not move with rotational movement, a ring 27 is engaged on the tube 21 and includes two keys 271 engaged with the slots 211 such that the ring 27 rotates in concert with the tube 21, the ring 27 includes two projections 273 extended therefrom for engaging with a pair of shoulders 62 formed in the slide 6, and includes a projection 272 for engaging with a pair of ears 63 of the slide 6 (FIGS. 10, 11) so as to move the slide 6 downward against the spring 115 when the ring 27 is rotated, and one or more washers 28 may be engaged beside the ring 27.

A pole 31 is extended through a shaft 32 and has one end engaged with the outer knob 3 such that the pole 31 rotates in concert with the outer knob 3, a disc 33 is fixed on the pole 31 and rotated in concert with the pole 31, the disc 33 includes a groove 331 for engaging with the extensions 261 of the follower 26, the disc 33 and the outer knob 3 are rotated in concert with the follower 26 when the extensions 261 are engaged with the groove 331, in which the follower 26 rotates in concert with the tube 21; and the outer knob 3 is freely rotatable when the extensions 261 are disengaged from the groove 331 of the disc 33. The shaft 32 is coupled to the latch 14 by a conventional coupling means (not shown) so as to actuate the latch 14, the shaft 32 includes two lumps 321 for engaging with the slots 212 of the tube 21 such that the shaft 32 rotates in concert with the tube 21, and such that the shaft 32 can be rotated by the inner knob 2. A positioning plate 34 is engaged with a recess 322 formed in the shaft 32 and is engaged with the tube 21 so as to retain the disc 33 in place. An electric control device 7 is disposed in the outer cap 12, when an accurate card is inserted into the control device 7, the coil 25 may be actuated to move the follower 26 to engage with the disc 33. The slide 6 includes two oblong holes 65 for engaging with axle 52 and shaft 32.

Referring next to FIGS. 6 to 9, a lock 41 is fixed to a board 43 by screws 42 and fixed within the door panel 10, a spring 411 engaged in the lock 41 (FIGS. 8 and 9), a control barrel 4 rotatably engaged on the lock 41, an internal gear 44 including a plurality of inner teeth 442 and a plurality of lugs 441 extended outward from the outer peripheral surface thereof for engaging with corresponding depressions formed in the control barrel 4 so as to be rotated in concert with the control barrel 4, a spring 46 and a ball 47 engaged in the lock 41 for engaging with the teeth 442 so as to position the control barrel 4. The lock 41 includes a rotatable core 48 having a beam 49 extended therefrom for engaging with the opening 51 of the inner knob 5 such that the beam 49 and the core 48 can be directly rotated by the inner knob, the beam 49 is coupled to the latch 15 for actuating the latch 15, a casing 45 is engaged on the core 48 and includes an opening 451 for engaging with the beam 49 so as to be rotated in concert with the beam 49, a tooth 452 extended from the casing 45 for engaging with the teeth 442 of the inner gear 44, and a number of protrusions 453 extended from the casing 45 for engaging with the spring 411 such that the casing 45 can be maintained in suitable angular position.

Figure 5:
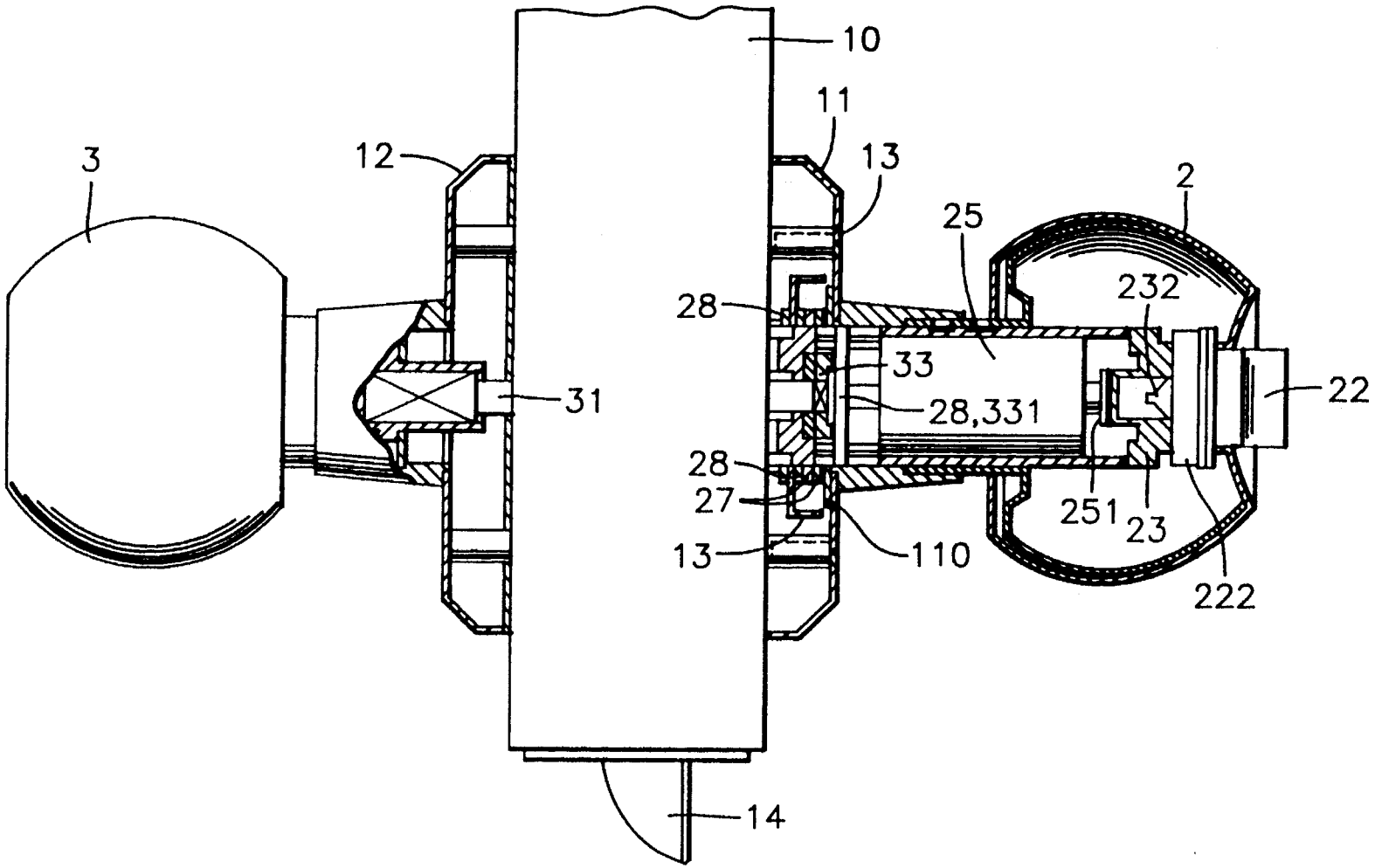

In operation, as shown in FIG. 5, when the extensions 261 of the follower 25 are engaged with the groove 331 of the disc 33, the shaft 32 can be rotated by both of the inner knob 2 and the outer knob 3 in order to move the latch 14.

However, as shown in FIG. 4, when the button 22 is rotated for 90 degrees, the extensions 261 are disengaged from the groove 331, at this moment, the shaft 32 can be rotated by the inner knob 2 by the engagement of the lumps 321 with the slots 212 of the tube 21, such that the latch 14 can also be actuated by the inner knob 2; however, at this moment, the disc 33 and the pole 31 are freely rotatable such that the outer knob may not actuate the latch 14.

Figure 1:
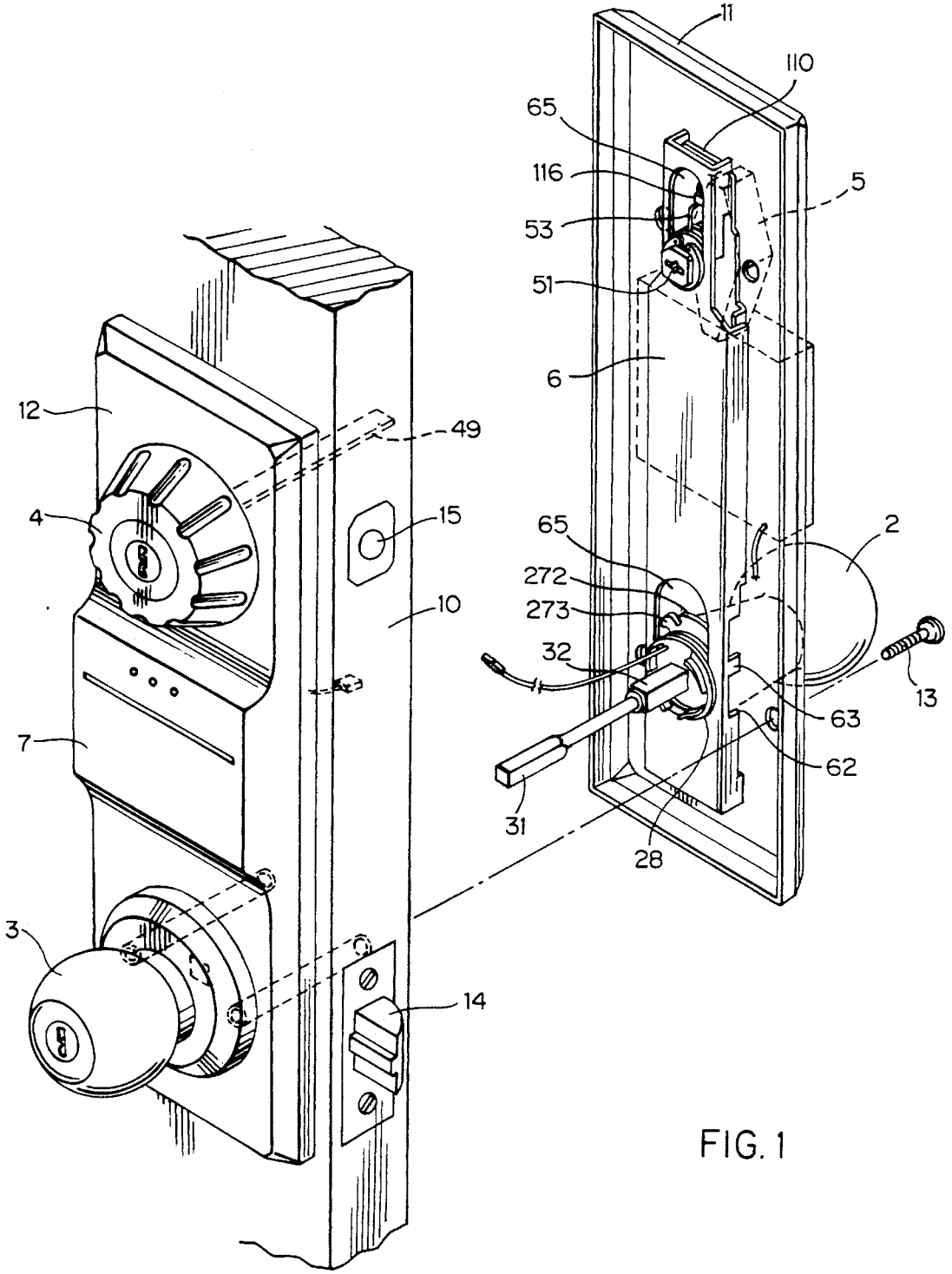
FIG. 1 is an exploded view of a door lock assembly in accordance with the present invention
Figure 2:
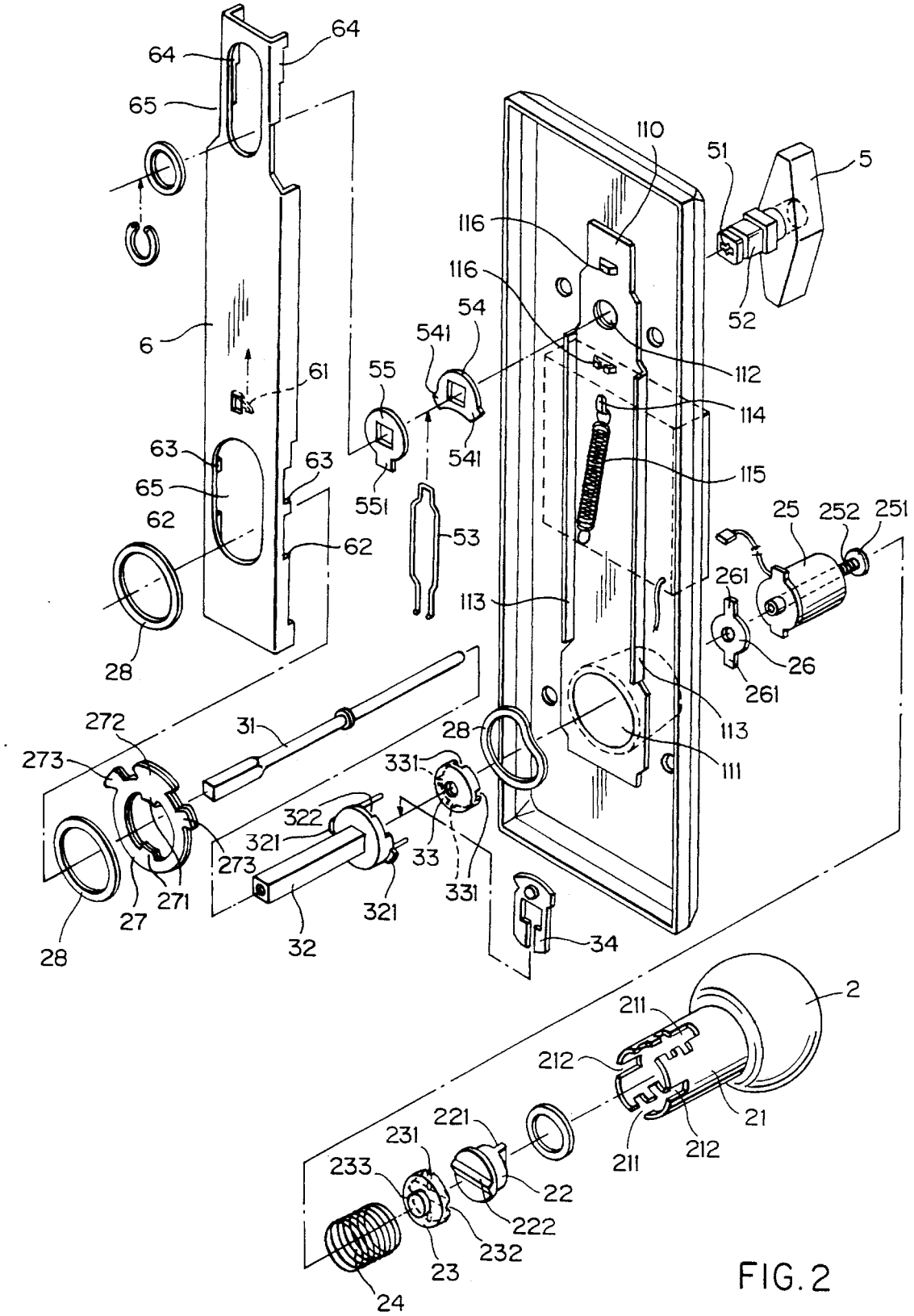
FIG. 2 is an exploded view showing the inner parts of the door lock assembly.
Figure 3:
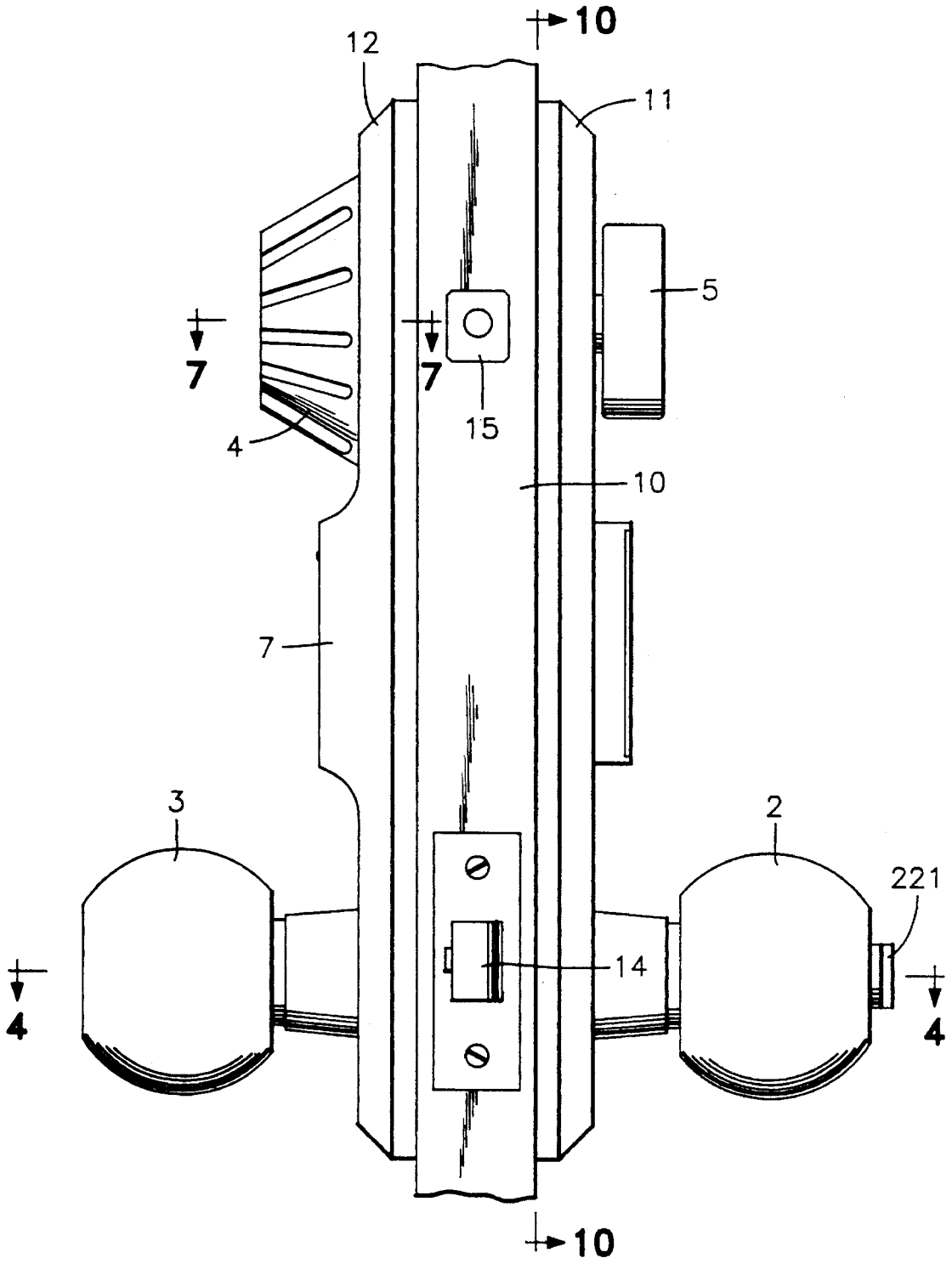
FIG. 3 is a plane view of the door lock assembly.
Figure 6:
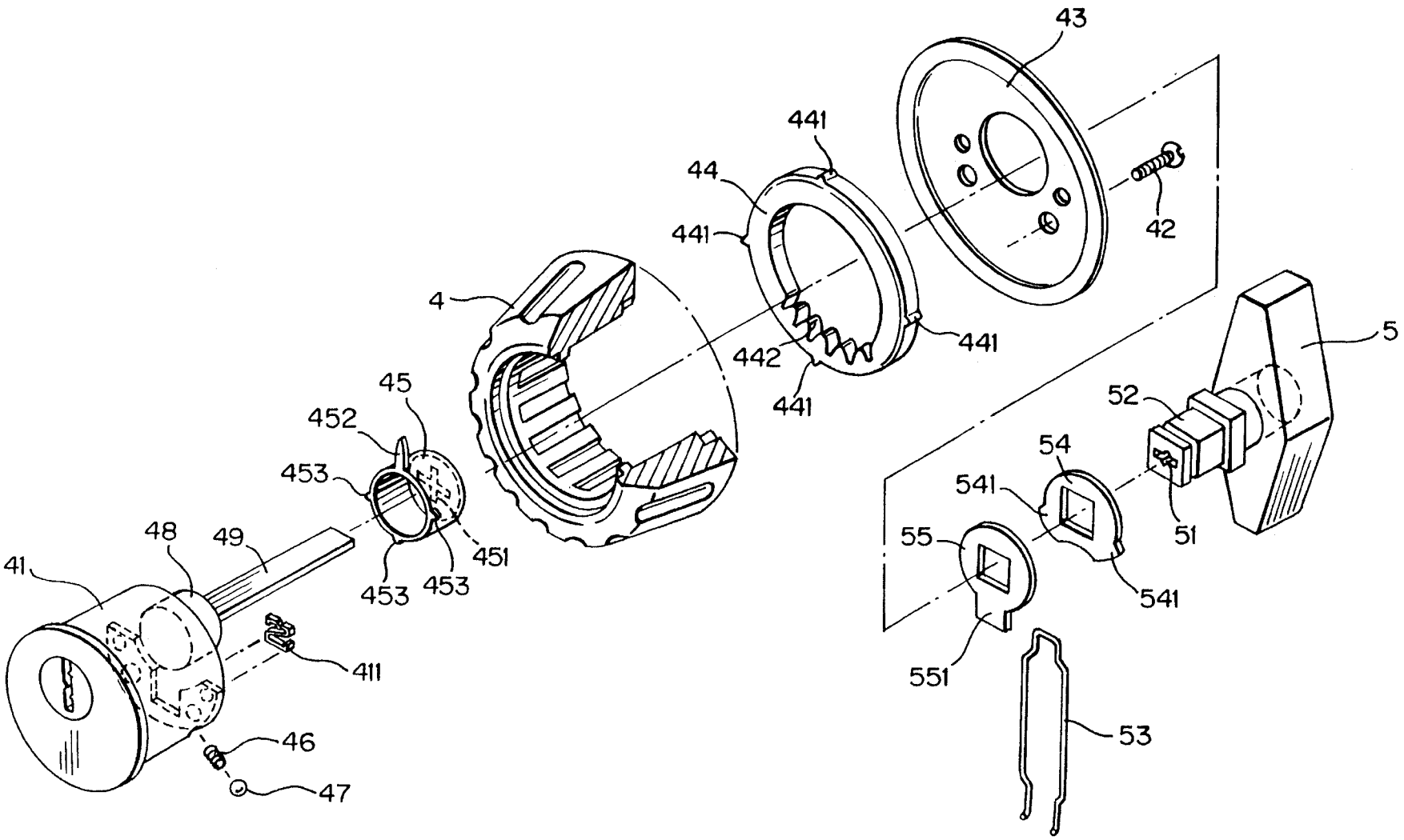
FIG. 6 is an exploded view showing the auxiliary lock of the door lock assembly.
Figure 7:
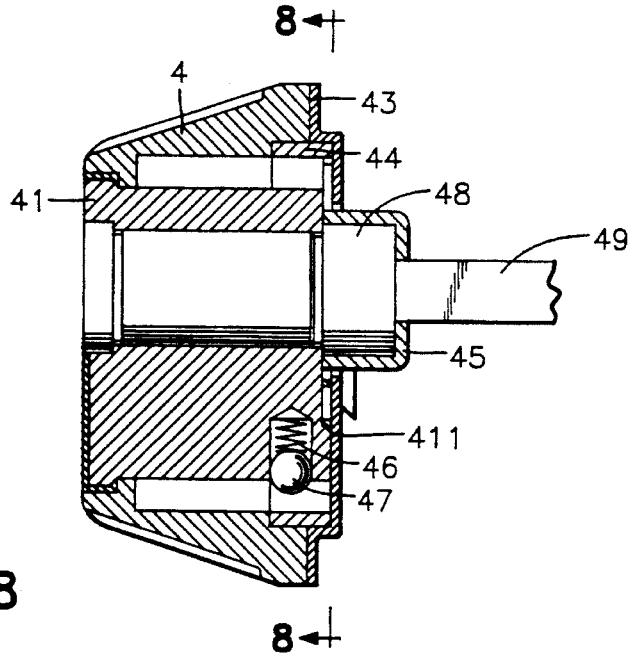
FIG. 7 is a cross sectional view taken along lines 7—7 of FIG. 3.

As shown in FIGS. 2 and 6, when the inner knob 5 is rotated, the beam 49 can be rotated in order to actuate the latch 15 so as to further lock the door panel 10 in place. If the outer knob 3 is locked, the outer knob 3 can not be rotated. However, if the outer knob 3 is rotatable, as shown in FIGS. 2 and 10, the ring 27 can be rotated by the inner knob 2 such that the projections 273 may actuate the shoulders 62, and the projection 272 may actuate the ears 63 when the projections 273 are not actuating the shoulders 62, whereby, the slide 6 can be moved downward, at this moment, the shoulders 64 may actuate the projections 541, 551 so as to rotate the axle 52 in order to retract the latch 15, the door panel is thereby unlocked.

Figure 8:
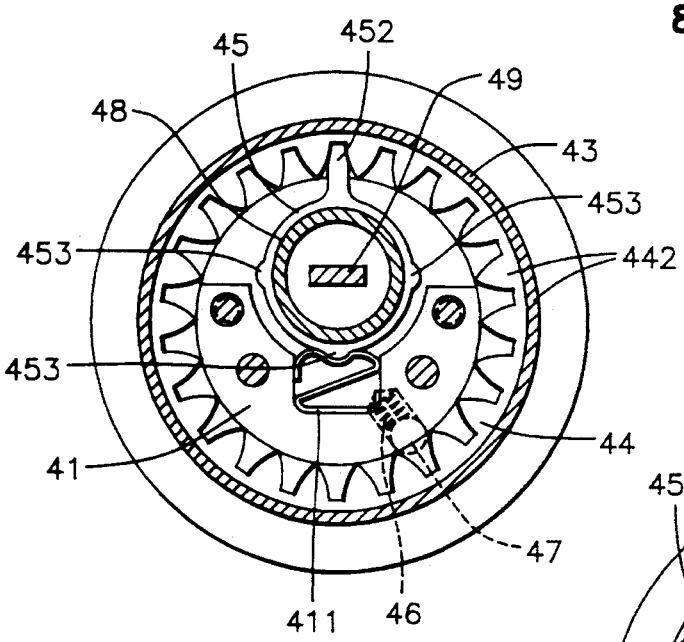
FIGS. 8 and 9 are cross sectional views taken along lines 8—8 of FIG. 7.
Figure 9:
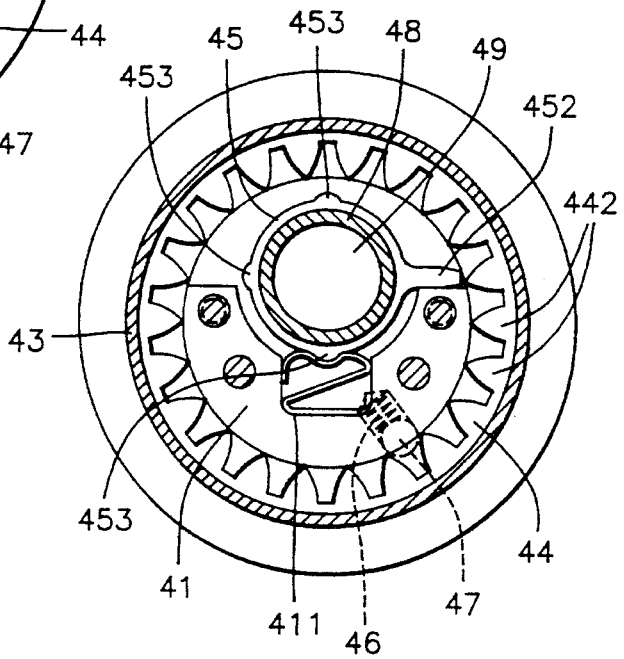

As shown in FIGS. 8 and 9, the core 48 and the casing 45 are eccentric relative to the control barrel 4 such that the tooth 452 may engage with or disengage from the teeth 442 of the inner gear 44 when the control barrel 4 is rotated. When the tooth 452 is engaged with the teeth 442, as shown in FIG. 8, and when the control barrel 4 is rotated, the casing 45 and the beam 49 can be rotated to move the latch 15 outward to lock the door panel, however, when the control barrel 4 is rotated for more than 60 degrees, the tooth 452 is disengaged from the teeth 442 such that the casing 45 and the beam 49 can no longer be rotated by the control barrel 4, as shown in FIG. 9, whereby, the door panel is suitably locked by the latch 15.

Accordingly, the door lock assembly in accordance with the present invention includes a mechanism for actuating both the upper and the lower latches.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A door lock assembly comprising an inner cap and an outer cap for fixing to a door panel, a slide slidably disposed in said inner cap and movable up and down and including a lower end portion having a first shoulder means formed therein and an upper end having a second shoulder means formed therein, means for biasing said slide upward, a first inner knob including a tube extended through said inner cap, a button slidably disposed in said first inner knob and slightly extended outward of said first inner knob, a rod slidably disposed in said tube and engaged with said button, a follower fixed on said rod and including at least one extension extended therefrom, an outer knob engaged with said outer cap, a shaft secured to said tube, a pole extended through said shaft and including a first end secured to said outer knob such that said pole rotates in concert with said outer knob and including a second end having a disc fixed thereon and rotated in concert with said pole, said disc including a groove for engaging with said extension of said follower, said disc and said outer knob being rotated in concert with said follower when said extension is engaged with said groove, said outer knob being freely rotatable when said extension is disengaged from said groove, a ring secured on said tube and including at least one first projection extended therefrom for engaging with said first shoulder means of said slide so as to move said slide downward, a second inner knob including an axle engaged with said inner cap, at least one disc secured on said axle and including at least one second projection for engaging with said second shoulder means, said axle being rotated by said second projection and said second shoulder means when said slide is moved downward by said ring and when said first inner knob is rotated, whereby, said axle is actuated by said first inner knob.

2. An assembly as claimed in claim 1 wherein the axle of the second inner knob is coupled for rotation with a beam extending from a rotatable core of a manual lock, said lock having a surrounding control barrel coupled to an internal gear with inner teeth, said rotatable core having a casing coupled for rotation with said beam, said casing having a projecting tooth, said core and said casing being eccentric relative to said control barrel and said internal gear for selectively engaging and disengaging said projecting tooth with the inner teeth of said internal gear by rotation of said rotatable core whereby a latch coupled to said beam can be selectively locked and unlocked.

* * * * *